United States Patent [19]

Hamisch, Jr.

[11] 4,125,419

[45] Nov. 14, 1978

[54] HAND-HELD LABELER AND LABELING METHOD

[75] Inventor: Paul H. Hamisch, Jr., Franklin, Ohio

[73] Assignee: Monarch Marking Systems, Inc., Dayton, Ohio

[21] Appl. No.: 816,821

[22] Filed: Jul. 18, 1977

[51] Int. Cl.[2] ..... B41M 1/00

[52] U.S. Cl. ..... 156/277; 74/53; 101/290; 101/291; 156/344; 156/384; 156/387; 156/540; 156/584; 156/DIG. 49

[58] Field of Search ..... 156/277, 344, 384, 387, 156/579, 584, 230, 540, DIG. 49, 541; 101/289, 291, 292, 318, 290; 74/53

[56] References Cited

U.S. PATENT DOCUMENTS

| | | | |
|---|---|---|---|
| 1,665,467 | 4/1928 | Miller | 101/3 R |
| 3,408,931 | 11/1968 | Austin | 101/318 |
| 3,420,172 | 1/1969 | Kaplan | 101/291 |
| 3,782,279 | 1/1974 | Carboni et al. | 156/384 |
| 3,814,651 | 6/1974 | Wada | 156/541 |
| 3,902,952 | 9/1975 | Penaluna | 156/384 |
| 3,911,817 | 10/1975 | Becker | 101/288 |
| 3,957,562 | 5/1976 | Hamisch | 156/384 |
| 4,057,452 | 11/1977 | Sato | 156/277 |
| 4,072,105 | 2/1978 | Becker et al. | 156/384 |

FOREIGN PATENT DOCUMENTS

| | | |
|---|---|---|
| 2,656,862 | 6/1977 | Fed. Rep. of Germany. |
| 2,729,097 | 1/1978 | Fed. Rep. of Germany. |

*Primary Examiner*—Jerome W. Massie
*Attorney, Agent, or Firm*—Joseph J. Grass

[57] ABSTRACT

There is disclosed a hand-held labeler and a method of labeling. The labeler includes a print head and a cooperable platen, a label delaminator, an applicator, and a feed wheel. The print head is urged into printing cooperation with the platen by a spring arrangement. A drive mechanism operated by an actuator holds the print head out of contact with the platen until printing is to occur and thereafter the feed wheel is driven to advance a label carrying web. The drive mechanism includes a lost-motion connection by which the print head can be quickly released to cause the print head to snap into printing cooperation with the platen.

23 Claims, 10 Drawing Figures

HAND-HELD LABELER AND LABELING METHOD

BACKGROUND OF THE INVENTION

1. Field of the Invention

This invention relates to the art of hand-held labelers and labeling methods.

2. Brief Description of the Prior Art

U.S. Pat. No. 1,665,467 to David B. Miller dated Apr. 10, 1928 discloses a stamping device in which a pivotally mounted hammer is tripped into printing cooperation with a marking stamp.

U.S. Pat. No. 3,408,931 to Charles C. Austin dated Nov. 5, 1968 discloses a hand-held label printer in which a print head is mounted for straight line reciprocating movement. This patent discloses cocking means responsive to an actuator for moving the print head from printing to a retracted position during the cycle, a detent for holding the print head in the retracted position during a subsequent part of the cycle, and trip means responsive to the actuator at or near the end of the cycle to disengage the detent, thereby permitting a spring to snap the print head into printing position.

Published German patent application No. P 23 45 249.5-27 (2530346) of Meto International GmbH discloses a hand-held labeler having an actuating lever and a spring-urged print head lever. The spring may be cocked by swinging the actuating lever up to the point of reaching a spring force which is greater than the maximum of resistance opposed to the movement of the printing mechanism toward the platen. When this occurs, the print head will be snapped against the platen with constant force independent of the force or speed of movement of the actuator lever.

U.S. Pat. No. 3,911,817 to Werner Becker et al dated Oct 14, 1975 discloses a device for printing and dispensing labels in which a printing mechanism and a label strip advancing mechanism are actuated by movement of a secondary lever and the secondary lever is moved by a primary lever only after actuation of the primary lever to exceed a predetermined biasing force tending to maintain the secondary lever stationary.

U.S. Pat. No. 3,782,279 to Victor B. Carboni, Jr. et al dated Jan. 1, 1974 discloses a hand-held labeler having a pivotal print head, a platen, a toothed feed wheel, an actuator or trigger, a pawl and ratchet mechanism driven in response to movement of the actuator and a drive mechanism, specifically a pivoted member. The pivoted member drives the print head out of cooperation with the platen when the actuator is actuated to allow the feed wheel to advance the label web. In that printing takes place after the label is advanced, one or more partially printed labels are left in the labeler following at the end of the cycle. In accordance with an improved version of the labeler according to U.S. Pat. No. 3,782,279, the actuator drives a first lever which has a first integral gear segment. The first lever and first gear segment are disposed coaxially with respect to the feed wheel and with respect to ratchet teeth which are integral with the feed wheel. The first gear segment meshes with a second gear segment. The second gear segment is integrally connected to a second lever which holds a spring urged print head, like the print head in U.S. Pat. No. 3,782,279, out of cooperation with the platen until the proper time in the cycle. In this improved version, the label is advanced after the label is imprinted, however in both versions the user can affect the action the print head by varying the rate of operation of the actuator.

U.S. Pat. No. 3,957,562 to Paul H. Hamisch, Jr. dated May 18, 1976 discloses a labeler in which a first lever has a first gear segment which meshes with a second gear segment. The second gear segment has a second lever which drives the print head into printing cooperation with the platen.

SUMMARY OF THE INVENTION

According to the present invention, there is provided a hand-held labeler which includes a frame with a handle, an actuator disposed at the handle for movement between an initial position and an actuated position, a platen, print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, and spring means for urging the print head into cooperation with the platen. An improved drive mechanism is used to drive the print head away from the platen against the urging action of the spring and for thereafter driving the feed wheel to advance the just printed label into label applying relationship with respect to the label applying means. The drive mechanism incorporates the feature which makes the movement of the print head to printing cooperation with the platen considerably less dependent upon the rate at which the user moves the actuator from the initial to the actuated position. In fact, the print head drives part of the drive mechanism out of the way as soon as the actuator has been moved through a predetermined distance or increment from the initial position toward the actuated position, thereby enabling the print head to be spring driven into printing cooperation with the platen. In one specific embodiment, the drive mechanism includes a print head lever driven in response to movement of the actuator and means for providing independent movement of the lever with respect to the actuator. The print head has a cam cooperable with the lever and the lever is movable between a first position in which the lever acts on the cam to hold the print head out of cooperation with the platen and a second position in which the lever is out of cooperation with the cam. The cam is used to drive the lever quickly to the second position when the lever has moved between the initial position and the actuated position to provide quick release of the print head. It is also preferred to have a drive lever for driving the print head lever. These levers are suitably drivingly connected, as for example by a pair of cooperable gear segments or segmental gears. In one embodiment a lost-motion connection is provided between the print head lever and a cooperating gear segment, in another embodiment a lost-motion connection is provided between the drive lever and a respective gear segment and in yet another embodiment lost-motion connection is provided between the actuator and the drive lever. The method of invention comprises the steps of providing a print head, a platen with which the print head cooperates, a delaminator adjacent the platen, an applicator adjacent the delaminator, a driver for advancing the web, and an actuator which is movable between an initial position and an actuated position, spring urging the print head into contact with the platen, holding the print head out of cooperation with the platen against the spring urging action, manually moving the actuator from the initial position in which the print head is held in a first position by the lever out of cooperation with the platen to the actuator position in which the print head is in a second position and is free to be spring urged into cooperation with the platen, urging the lever into the second position under the spring urging action to override the actuator while the actuator is between the initial position and the actuated position, and driving the driver to advance the web only when the actuator has been moved to the actuated position to enable the print head to be quickly released and spring urged into printing cooperation with the platen, driving the driver to advance the web and thus at least partially delaminating a label at the delaminator only when the actuator has been moved to the actuated position, and applying a printed label.

DETAILED DESCRIPTION OF THE PREFERRED EMBODIMENTS

Figures 1, 2, 3, 4, 5:
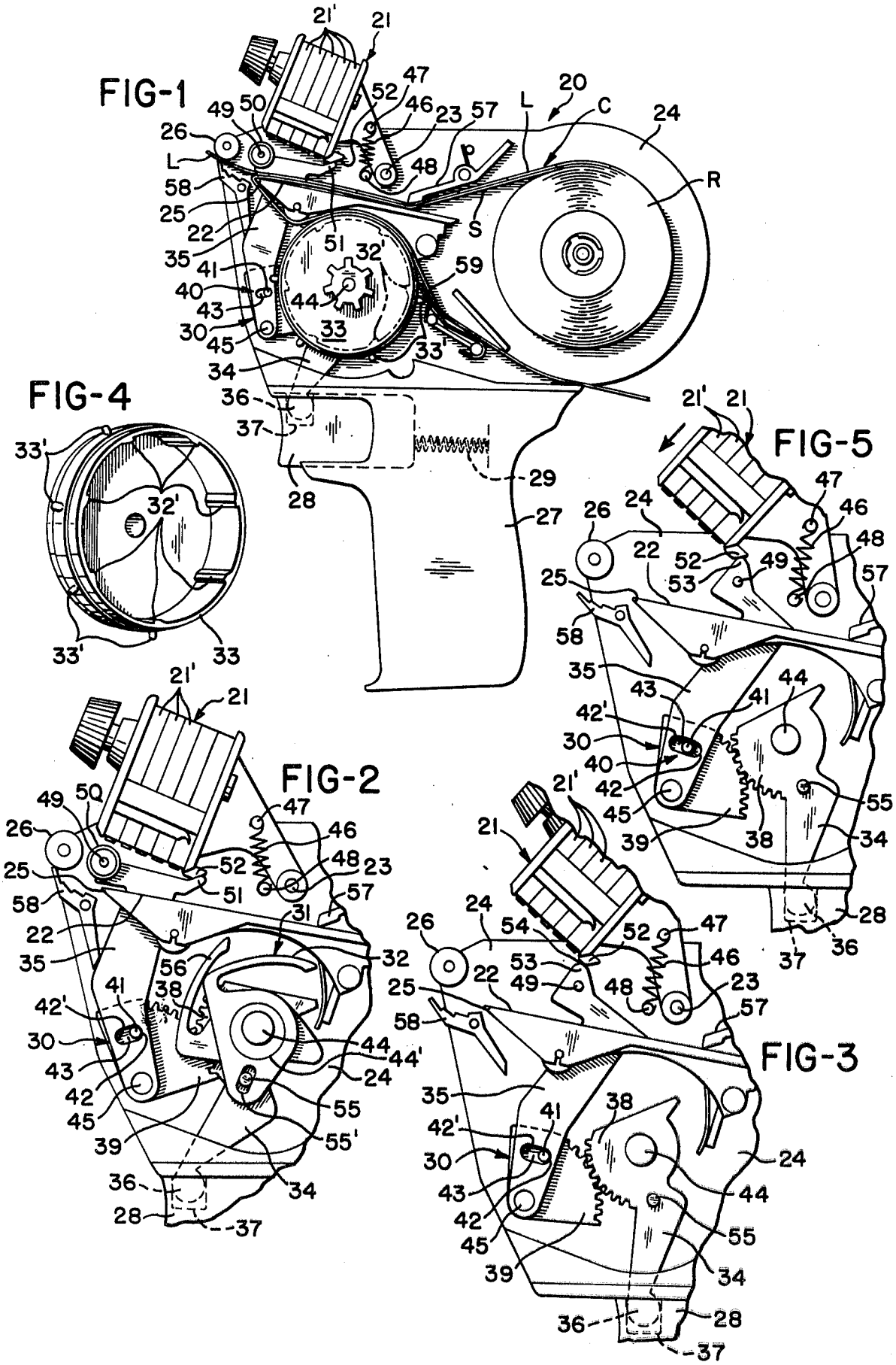
FIG. 1 is a side elevational view of a hand-held labeler incorporating the invention with the component parts being shown in their initial positions.
FIG. 2 is an enlarged fragmentary elevational view of the labeler with its feed wheel removed for clarity, with its component parts shown in their initial positions.
FIG. 3 is a fragmentary elevational view similar to FIG. 2, but with the drive and detent pawls omitted and the actuator and drive mechanism being shown moved away from their initial positions.
FIG. 4 is a perspective view showing the opposite side of the feed wheel and its ratchet teeth from that shown in FIG. 1.
FIG. 5 is a fragmentary elevational view similar to FIGS. 2 and 3 but showing the drive mechanism being driven out of the way as the print head is snapped toward the platen.
Figure 6:
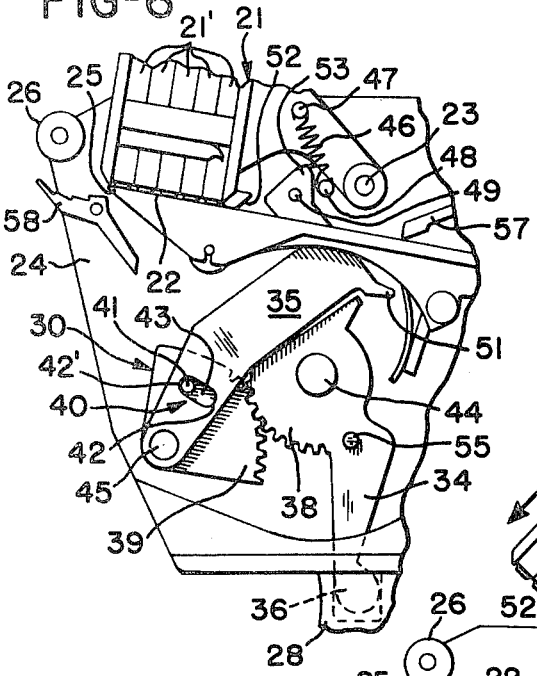
FIG. 6 is a fragmentary elevational view similar to FIGS. 2, 3 and 4, but with the print head being shown cooperating with the platen.

With reference to FIG. 1, there is shown a hand-held labeler or label printing and applying apparatus generally indicated at 20 which carries a supply roll R of a composite web C. The composite web C includes labels L carried on a web of supporting material S. The composite web C is not shown in the other figures. The labeler 20 includes a print head generally indicated at 21 and a platen 22 with which the print head 21 cooperates. The print head 21 is shown to be pivotally mounted on a post 23 secured to labeler frame 24. The platen 22 is also mounted to the frame 24. A peel edge or delaminator 25 is shown to be at or near the end of the platen 22. While the peel edge 25 is shown to be provided by the terminal end of the platen 22, it can for example be provided by a small diameter roller if desired. An applicator 26 shown for example to be in the form of a roll is disposed adjacent the delaminator 25. The frame 24 has a handle or handle portion 27. A manually operable actuator 28 is slidably mounted at the handle portion 27. The actuator 28 is urged to the initial position shown in FIGS. 1 and 2 by a compression spring 29. A drive mechanism generally indicated at 30 holds the print head 21 out of cooperation with the platen 22 until the actuator 28 has been moved through a predetermined distance or increment. A pawl and ratchet mechanism generally indicated at 31 and which includes a pawl 32 and ratchet teeth 32' drives a driver such as a feed wheel 33 only when the actuator 28 has been moved to the actuated position and only upon release of the actuator 28 due to the force exerted by the spring 29 to advance the just printed label into label applying relationship with respect to the applicator 26. The pawl 32 is pivotally mounted on an eccentric 44' which is secured to the pawl 56. With reference to FIGS. 1 and 2, the drive mechanism 30 is shown to include a drive lever 34 and a print head lever 35 driven by the drive lever 34 through a lost-motion connection generally indicated at 40 when the actuator 28 is actuated. As shown, the lever 34 has a generally circular-shaped end portion 36 which is received in a recess or socket 37 in the actuator 28. The drive lever 34 and the print head lever 35 are preferably coupled to each other through meshing gear segments or segmental gears 38 and 39. The gear segments 38 and 39 have involute contoured teeth and as such provide rolling contact conducive to low friction and are thus preferable to a link connection. The lost-motion connection 40 is shown to include a pin or projection 41 formed integrally with the gear segment 39 which is shown in FIGS. 1, 2 and 3 to cooperate with one end 42 of a cutout or slot 43. As best shown in FIGS. 3 and 5, the lever 34 and the gear segment 38 are formed integrally with each other but they can be made separately and suitably keyed or joined together as desired. The gear segment 38 and hence also the lever 34 are pivotally mounted on a post or pin 44 secured to the frame 24. The gear segment 39 and the print head lever 35 are shown to be pivotally mounted on a post or pin 45 secured to the frame 24. Although the pin 41 is connected to the gear segment 39 and the cutout 43 and the stop or abutment face 42 are on the lever 35, this arrangement can be reversed so that the pin is on the print head lever 3 and the cutout is in the gear segment 39.

When the actuator 38 is moved from the initial position shown in FIGS. 1 and 2 to the partially actuated position shown in FIG. 3, the lever 34 and the associated gear segment 38 rotate counterclockwise and the gear segment 39 and the lever 35 are driven clockwise. In that the pin 41 is in contact with the abutment face 42, the print head lever 35 is driven to the position shown in FIG. 3 to drive the print head 21 clockwise from the position shown in FIGS. 1 and 2. A tension spring 46 normally urges the print head 21 in a counterclockwise direction as viewed in FIGS. 1 and 3 through 6. The spring 46 is connected at its one end portion to a pin or post 47 secured to the print head 21 and at its other end portion to a pin or post 48 connected to the frame 24.

The print head lever 35 carries a pin 49 which rotatably mounts an ink roller 50. The ink roller 50 has been omitted in FIGS. 3, 5 and 6 of this embodiment for the sake of clarity. In FIGS. 1 and 2, the ink roller 50 is shown to be out of contact with the printing elements 21' of the print head 21. As the print head lever 35 pivots clockwise, the portion 51 of the lever 35 contacts cam portion or surface 52 to hold the print head out of contact with the ink roller 50. As the lever 35 pivots clockwise to the position shown in FIG. 3, the print head 21 pivots counterclockwise due to its own weight and the action of the spring 46 so that the printing elements 21' are inked by the ink roller 50. When portion 53 of the lever 35 contacts portion or cam surface 54, the print head 21 is again pivoted clockwise against the action of the spring 46. Continued movement of the actuator 28 will cause the portion 53 of the lever to contact the cam surface 52 as shown in FIG. 5. As soon as the cam surface 52 contacts portion 53, the lever 35 is quickly urged clockwise to an out-of-the-way position shown in FIG. 6. The other end of the cutout 43 provides an abutment face or surface 42' which limits the clockwise travel of the lever 35. Accordingly, the lever 35 and the gear segment 39 move independently when the forces exerted on the lever 35 change direction. In that the lever 35 is quickly moved out of the way to the position shown in FIG. 6, the action of the print head 21 remains relatively constant irrespective of the rate at which the actuator 28 is moved from the initial position shown in FIG. 1 to the actuated position shown in FIG. 6. The lost-motion connection 40 enables the lever 35 to override the actuator 28 under the urging of the spring urged print head 21. When the actuator 28 is released, the spring 29 causes the lever 34 and the gear segment 38 to be rotated clockwise and thus the gear segment 39 and the lever 35 are rotated counterclockwise and the end portion 53 of the lever 35 contacts the cam surface 52 to urge the print head 21 clockwise. Thus the print head 21, the lever 35, the gear segment 39, the gear segment 38 the lever 34 and the actuator 28 are returned to their initial positions shown in FIG. 1. Upon release of the actuator 28, the pawl 31 cooperates with one of the teeth 32' which are coupled to the feed wheel to advance the supporting material S to a position in which the just printed label is in at least almost entirely delaminated from the web S.

It is preferred that the feed wheel 33 have a plurality of teeth 33' which engage the supporting material web S. The pawl 32 is shown to be coupled to the lever 34 through a pin 55 received in a cutout 55' in the pawl 31. A pawl 56 received on the pivot 44 between the pawl 31 and the gear segment 38 is keyed to the frame 24 and prevents counterclockwise movement of the feed wheel 33 as viewed in FIG. 1. The labeler 20 also includes a brake 57, a label guide 58 and a stripper 59.

Figure 7:
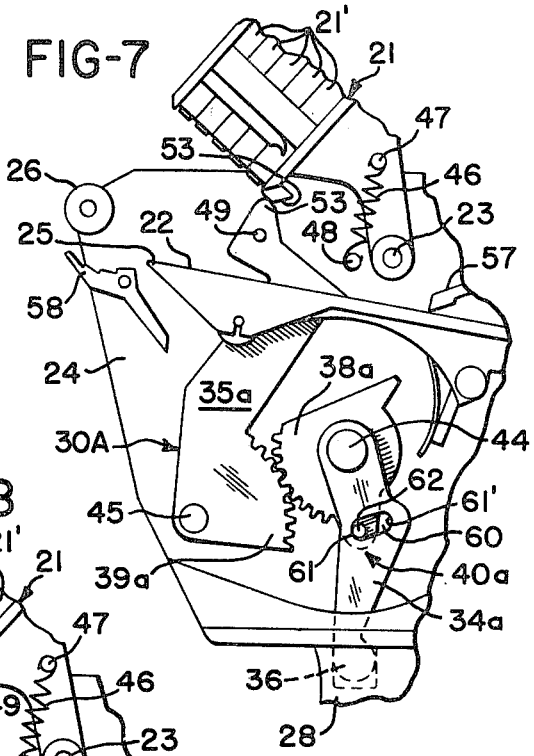
FIG. 7 is a fragmentary elevational view showing an alternative embodiment of the drive mechanism with the drive mechanism being shown as having been moved to a position in which the print head is almost ready to cam a portion of the drive mechanism out of the way.
Figure 8:
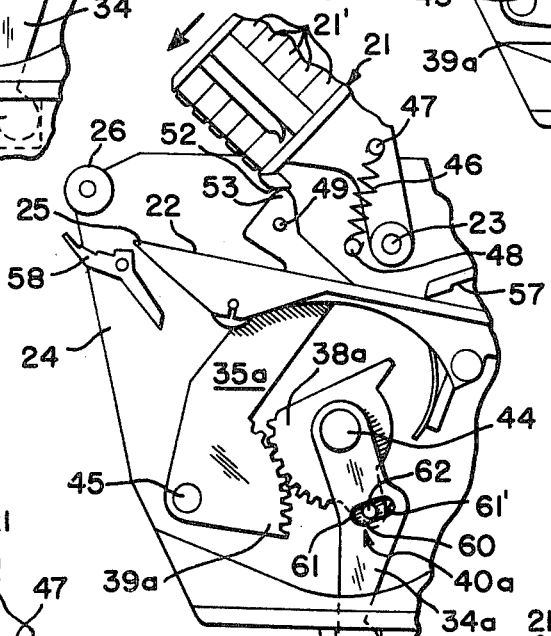
FIG. 8 is a fragmentary elevational view similar to FIG. 7 but showing the print head as camming a portion of the drive mechanism out of the way thereby enabling the print head to be snapped into cooperation with the platen.

The embodiment of FIGS. 7 and 8 is identical to the embodiment of FIGS. 1 through 6 except that the drive mechanism 30A differs from the drive mechanism 30. In the embodiment of FIGS. 7 and 8, the actuator 28 drives a drive lever 34*a* which is pivotally mounted on the pivot 44. The lever 34*a* has a cutout 60 with an abutment face 61 which is cooperable with a pin 62 formed integrally with gear segment or segmental gear 38*a*. Alternatively, this arrangement can be reversed in that the pin can be carried by the lever 34*a* and a cutout can be in the gear segment 38*a*. The gear segment or segmental gear 39*a* is shown to be formed integrally with lever 35*a*, although they can be formed using a gear segment and a lever that are formed separately but are suitably connected to each other. The overall operation of the embodiment of FIGS. 7 and 8 is the same as in the embodiment of FIGS. 1 through 6 except that when the portion 53 of the lever 35*a* is in contact with the cam surface 52 the lever 35*a*, the gear segment 39*a*, and the gear segment 38*a* are all moved quickly out of the way due to the lost-motion connection 40*a* provided by a pin 62 in the cutout 60. The other end of the cutout 60 provides an abutment face 61'.

Figure 9:
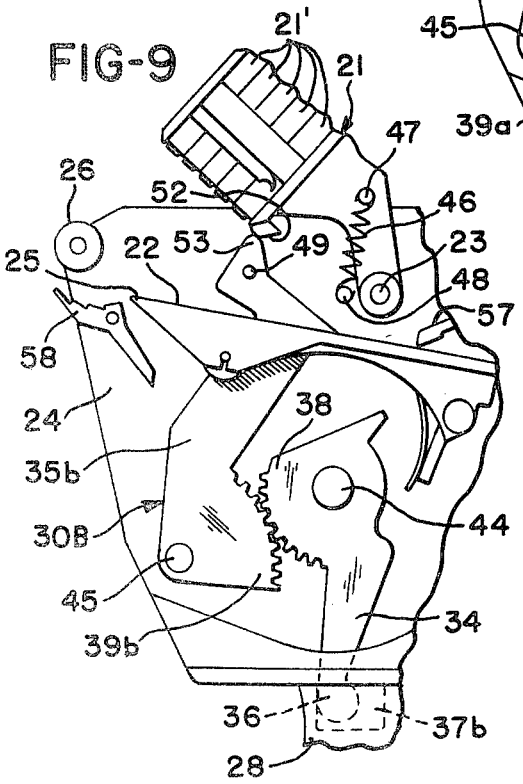
FIG. 9 is a fragmentary elevational view showing another alternative embodiment of the drive mechanism with the drive mechanism being shown as having been moved to a position in which the print head is almost ready to cam the drive mechanism out of the way.
Figure 10:
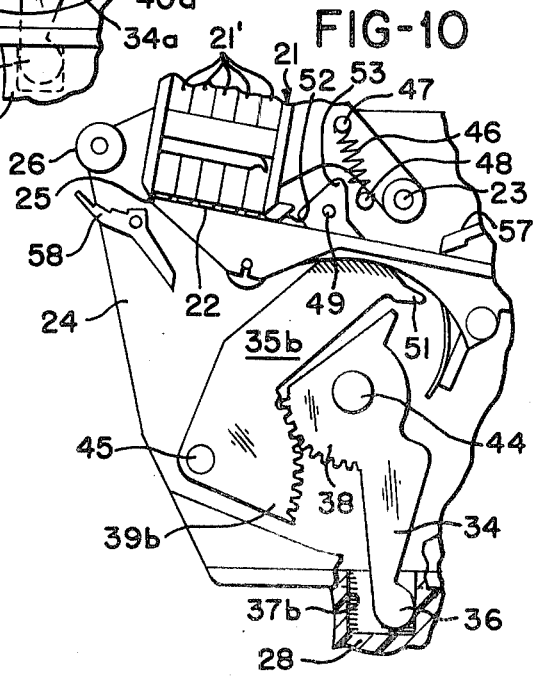
FIG. 10 is an elevational view similar to FIG. 9 but showing the print head as having cammed the drive mechanism out of the way and the print head as having moved into printing cooperation with the platen.

The embodiment of FIGS. 9 and 10 is identical to the embodiment of FIGS. 1 through 6 except that the drive mechanism 30B differs from the drive mechanism 30. The drive mechanism 30B includes a lever 34 formed integrally with the gear segment 38 as in the embodiment of FIGS. 1 through 6. The gear segment 38 meshes with a gear segment or segmental gear 39*b* formed integrally with lever 35*b*. It is apparent that the gear segment 39*b* and the lever 35*b* can be formed separately and suitably connected to each other. When the portion 53 of the lever 35*b* contacts the surface 52, the lever 35*b* is quickly driven out of the way, thereby causing the lever 34 to rotate counterclockwise. The end portion 36 of the lever 34 is received in an oversize or elongated recess or socket 37*b*. The lever 34 is free to swing counterclockwise from contact with one end of the socket from the position shown in FIG. 9 to the position shown in FIG. 10 to enable the lever 35*b* to get out of the way quickly so that the print head 21 can snapped into printing cooperation with the platen 22.

In the embodiments of FIGS. 1 through 6 and 7 and 8, the respective actuators 28 can be eliminated and the respective levers 34 and 34*a* can be extended to be manually graspable by the user, and therefore the levers 34 and 34*a*, thus extended, can serve as actuators.

Other embodiments and modifications of this invention will suggest themselves to those skilled in the art, and all such of these as come within the spirit of the invention are included within its scope as best defined by the appended claims.

I claim:

1. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever driven in response to movement of the actuator and means for providing independent movement of the lever with respect to the actuator, the print head having a cam cooperable with the lever, the lever being movable between a first position at which the lever acts on the cam to hold the print head out of cooperation with the platen and a second position in which the lever is out of holding cooperation with the cam, the spring means being effective to move the cam to drive the lever quickly to the second position when the actuator has been moved to between the initial position and the actuated position to effect quick release of the print head and to move the released print head into printing cooperation with the platen.

2. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever driven in response to movement of the actuator and means for providing independent movement of the lever with respect to the actuator, the print head having a cam cooperable with the lever, the lever being movable between a first position at which the lever acts on the cam to hold the print head out of cooperation with the platen and a second position in which the lever is out of holding cooperation with the cam, the spring means being effective to move the cam to drive the lever quickly to the second position when the actuator has been moved to between the initial position and the actuated position to effect quick release of the print head and to move the released print head into printing cooperation with the platen, the drive mechanism further including a pawl and ratchet mechanism operable to drive the feed wheel only when the actuator has reached the actuated position.

3. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever and means for providing independent movement of the lever with respect to the actuator, a first gear segment coupled to the lever, and a second gear segment meshing with the first gear segment and driven in response to movement of the actuator, the print head having a cam cooperable with the lever, the lever being movable between a first position at which the lever acts on the cam to hold the print head out of cooperation with the platen and a second position in which the lever is out of holding cooperation with the cam, the spring means being effective to move the cam to drive the lever quickly to the second position when the actuator has been moved to between the initial position and the actuated position to effect quick release of the print head and to move the released print head into printing cooperation with the platen.

4. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism being driven in response to movement of the actuator and including a lost-motion connection, the drive mechanism having holding means movable between a first position at which the print head is held out of cooperation with the platen and a second position at which the holding means is out of holding cooperation with the print head, the lost-motion connection enabling the holding means to be moved quickly to the second position by the spring means when the actuator has been moved to between the initial position and the actuated position to effect quick release of the print head and the spring means being effective to move the released print head into printing cooperation with the platen.

5. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism being driven in response to movement of the actuator and including a lost-motion connection, the drive mechanism having holding means movable between a first position at which the print head is held out of cooperation with the platen and a second position at which the holding means is out of holding cooperation with the print head, the lost-motion connection enabling the holding means to be moved quickly to the second position under the urging of the spring means when the actuator has been moved to between the initial position and the actuated position to effect quick release of the print head and the spring means being effective to move the released print head into printing cooperation with the platen, the drive mechanism further including a pawl and ratchet mechanism operable to drive the feed wheel only when the actuator has reached the actuated position.

6. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging actin of the spring means and for thereafter driving the feed wheel to advance the just printed label into label applying relationship with respect to the applying means, the drive mechanism including meshing driving and driven gear segments driven in response to movement of the actuator and a lost-motion connection, the drive mechanism having holding means movable between a first position at which the print head is held out of cooperation with the platen and a second position at which the holding means is out of holding cooperation with the print head, the lost-motion connection enabling the holding means to be moved quickly to the second position by the spring means when the actuator has been moved to between the initial position and the actuated position to effect quick release of the print head and the spring means being effective to move the released print head into printing cooperation with the platen.

7. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever driven in response to movement of the actuator and a lost-motion connection between the actuator and the lever, the print head having a cam cooperable with the lever, the lever being movable between a first position at which the lever acts on the cam to hold the print head out of cooperation with the platen and a second position at which the lever is out of holding cooperation with the cam, the lost-motion connection enabling the cam to drive the lever quickly to the second position under the urging of the spring means when the actuator has been moved to between the initial position and the actuated position to effect quick release of the print head and the spring means being effective to move the released print head into printing cooperation with the platen.

8. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever driven in response to movement of the actuator and a lost-motion connection between the actuator and the lever, the print head having a cam cooperable with the lever, the lever being movable between a first position at which the lever acts on the cam to hold the print head out of cooperation with the platen and a second position at which the lever is out of holding cooperation with the cam, the lost-motion connection enabling the cam to drive the lever quickly to the second position under the urging of the spring means when the actuator has been moved to between the initial position and the actuated position to effect quick release of the print head and the spring means being effective to move the released print head into printing cooperation with the platen, the drive mechanism further includes a pawl and ratchet mechanism operable to drive the feed wheel only when the actuator has reached the actuated position.

9. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web, spring means for urging the print head into cooperation with the platen, and a drive mechanism for driving the print head away from the platen against the urging action of the spring means and for thereafter driving the feed wheel to advance the just printed label into label applying relationship with respect to the applying means, the drive mechanism including a lever, a first gear segment, and a second gear segment meshing with the first gear segment and driven in response to movement of the actuator and a lost-motion connection between the actuator and the lever, the print head having a cam cooperable with the lever, the lever being movable between a first position at which the lever acts on the cam to nating means for applying printed labels, a feed wheel engageable with the web for advancing the web and driven only when the actuator moves from the actuated position to the initial position, spring means for urging the print head into cooperation with the platen, a first lever, a lost-motion connection between the actuator and the first lever, a second lever, means for drivingly connecting the first and second levers, the print head having a cam with which the second lever cooperates, the second lever being movable between a first position in which the second lever acts on the cam to hold the print head out of cooperation with the platen and a second position in which the second lever is out of holding cooperation with the cam, the lost-motion connection connection enabling the cam to drive the second lever quickly to the second position under the urging of the spring means and to drive the connecting means and the first lever when the actuator has been moved to between the initial position and the actuated position to effect quick release of the print head and the spring means being effective to move the released print head into cooperation with the platen.

16. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a lost-motion connection between the actuator and the first lever, a second lever, means for drivingly connecting the first and second levers, the print head having a cam with which the second lever cooperates, the second lever being movable between a first position in which the second lever acts on the cam to hold the print head out of cooperation with the platen and a second position in which the second lever is out of holding cooperation with the cam, the cam has a first cam surface which exerts a force on the second lever to urge it in one direction under the urging of the spring means and a second cam surface which exerts a force on the second lever to urge it in the opposite direction under the urging of the spring means, the lost-motion connection enabling the second cam surface to drive the second lever quickly to the second position under the urging of the spring means and to drive the connecting means and the first lever when the actuator has been moved to between the initial position and the actuated position to effect quick release of the print head and the spring means being effective to move the released print head into cooperation with the platen.

17. Apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a second lever, a lost-motion connection between the first lever and the first gear segment, means for drivingly connecting the first and second levers, the print head having a cam with which the second lever cooperates, movable between a first position in which the second layer acts on the cam to hold the print head out of cooperation with the platen and a second position in which the second lever is out of holding cooperation with the cam, the cam has a first cam surface which exerts a force on the second lever to urge it in one direction under the urging force of the spring means and a second cam surface which exerts a force on the second lever to urge it in in one direction under the urging force of the spring means and a second cam surface which exerts a force on the second lever to urge it in the opposite direction under the urging force of the spring means, the lost-motion connection enabling the cam to drive the second lever quickly to the second position under the urging force of the spring means and to drive the first lever when the actuator has been moved to between the initial position and the actuated position to effect quick release of the print head and the spring means being effective to move the released print head into cooperation with the platen.

18. Hand-held apparatus for printing and applying pressure sensitive labels releasably carried on a web of supporting material, comprising: a frame having a handle, an actuator disposed at the handle and movable between an initial position and an actuated position; a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a second lever, means including a lost-motion connection for drivingly connecting the first and second levers, the print head having a cam with which the second lever cooperates, the second lever being movable between a first position in which the second lever acts on the cam to hold the print head out of cooperation with the platen and a second position in which the second lever is out of holding cooperation with the cam, the lost-motion connection enabling the cam to drive the second lever quickly to the second position under the urging of the spring means when the actuator has been moved to between the initial position and the actuated position to effect quick release of the print head and the spring means being effective to move the released print head into cooperation with the platen.

19. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a second lever, means including a lost-motion connection for drivingly connecting the first and second levers, the print head having a cam with which the second lever cooperates, the second lever being movable between a first position in which the second lever acts on the cam to hold the print head out of cooperation with the platen and a second position in which the second lever is out of holding cooperation with the cam, wherein the cam has a first cam surface which exerts a force on the second lever to urge it in one direction under the urging of the spring means and a second cam surface which exerts a force on the second lever to urge it in the opposite direction under the urging of the spring means, the lost-motion connection enabling the cam to drive the second lever quickly to the second position under the urging of the spring means when the actuator has been moved to between the initial position and the actuated position to effect quick release of the print head and the spring means being effective to move the released print head into cooperation with the platen.

20. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a second lever, means for drivingly connecting the first and second levers, a lost-motion connection between the first lever and the print head, the print head having a cam with which the second lever cooperates, the second lever being movable between a first position in which the second lever acts on the cam to hold the print head out of cooperation with the platen and a second position in which the second lever is out of holding cooperation with the cam, the lost-motion connection enabling the cam to drive the second lever quickly to the second position under the urging of the spring means when the actuator has been moved to between the initial position and the actuated position to effect quick release of the print head and the spring means being effective to move the released print head into cooperation with the platen.

21. Hand-held apparatus for printing and applying pressure sensitive labels releasably carried on a web of supporting material, comprising: a frame having a handle, an actuator disposed at the handle and movable between an initial position and an actuated position, a platen, a print head, means mounting the print head on the frame for movement into and out of printing cooperation with the platen, means disposed adjacent the platen for delaminating printed labels from the supporting material web, means disposed adjacent the delaminating means for applying printed labels, a feed wheel engageable with the web for advancing the web and driven only when the actuator moves from the actuated position to the initial position, spring means for urging the print head into cooperation with the platen, a first lever, a second lever, means for drivingly connecting the first and second levers, a lost-motion connection between the actuator and the print head, the print head having a cam with which the second lever cooperates, the second lever being movable between a first position in which the second lever acts on the cam to hold the print head out of cooperation with the platen and a second position in which the second lever is out of holding cooperation with the cam, wherein the cam has a first cam surface which exerts a force on the second lever to urge it in one direction under the urging of the spring means and a second cam surface which exerts a force on the second lever to urge it in the opposite direction under the urging of the spring means, the lost-motion connection enabling the cam to drive the second lever quickly to the second position under the urging of the spring means when the actuator has been moved to between the initial position and the actuated position to effect quick release of the print head and the spring means being effective to move the released print head into cooperation with the platen.

22. Method of printing and applying pressure sensitive labels releasably carried on a web of supporting material, comprising the steps of: providing a print head, a platen with which the print head cooperates, a delaminator adjacent the platen, an applicator adjacent the delaminator and a driver for advancing the web, and an actuator which is movable between an initial position and an actuated position; spring urging the print head into printing cooperation with the platen; holding the print head out of cooperation with the platen against the spring urging action; manually moving the actuator from the initial position in which the print head is held in a first position out of cooperation with the platen to the actuated position in which the print head is in a second position and is free to be spring urged into cooperation with the platen; urging the holding means into the second position under the spring urging action to override the actuator while the actuator is between the initial position and the actuated position to enable the print head to be quickly released and spring urged into printing cooperation with the platen; driving the driver to advance the web and thus at least partially delaminating a label at the delaminator only when the actuator has been moved to the actuated position; and applying the printed label.

23. Method of printing and applying pressure sensitive labels releasably carried on a web of supporting material, comprising the steps of: providing a print head, a platen with which the print head cooperates, a delaminator adjacent the platen, an applicator adjacent the delaminator and a driver for advancing the web, and an actuator which is movable between an initial position and an actuated position; spring urging the print head into printing cooperation with the platen; using a lever to hold the print head out of cooperation with the platen against the spring urging action; manually moving the actuator from the initial position in which the print head is held in a first position by the lever out of cooperation with the platen to the actuated position in which the print head is in a second position and is free to be spring urged into cooperation with the platen;

camming the lever into the second position under the spring urging action to override the actuator while the actuator is between the initial position and the actuated position to enable the print head to be quickly released and spring urged into printing cooperation with the platen, driving the driver to advance the web and thus at least partially delaminating a label at the delaminator only when the actuator has been moved to the actuated position; and applying the printed label.

* * * * *

UNITED STATES PATENT AND TRADEMARK OFFICE

CERTIFICATE OF CORRECTION

PATENT NO. : 4,125,419

DATED : November 14, 1978

INVENTOR(S) : PAUL H. HAMISCH, JR.

It is certified that error appears in the above-identified patent and that said Letters Patent are hereby corrected as shown below:

Column 4, line 57, "3" should be --35--. Column 9, line 25, "actin" should be --action--. Column 14, line 12, "layer" should be --lever--; line 35, after "position" (second occurrence) the semicolon ";" should be a --,-- comma.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*